US010840609B1

(12) United States Patent
Rogers

(10) Patent No.: US 10,840,609 B1
(45) Date of Patent: Nov. 17, 2020

(54) LOW-PROFILE RECTANGULAR TO CIRCULAR TRANSITION

(71) Applicant: The Boeing Company, Chicago, IL (US)

(72) Inventor: John E. Rogers, Owens Cross Roads, AL (US)

(73) Assignee: THE BOEING COMPANY, Chicago, IL (US)

( * ) Notice: Subject to any disclaimer, the term of this patent is extended or adjusted under 35 U.S.C. 154(b) by 35 days.

(21) Appl. No.: 16/399,048

(22) Filed: Apr. 30, 2019

(51) Int. Cl.
*H01Q 25/00* (2006.01)
*H01Q 21/00* (2006.01)
*H01Q 15/24* (2006.01)

(52) U.S. Cl.
CPC ..... *H01Q 25/00* (2013.01); *H01Q 15/244* (2013.01); *H01Q 21/0006* (2013.01)

(58) Field of Classification Search
None
See application file for complete search history.

(56) References Cited

U.S. PATENT DOCUMENTS

2011/0032159 A1* 2/2011 Wu ..... H01Q 21/245 343/702
2017/0338571 A1* 11/2017 Moosbrugger ..... H01Q 9/0414
2019/0173193 A1* 6/2019 Tomasic ..... H01P 1/17

OTHER PUBLICATIONS

Ponchak, G.E., Simons, R.N., "A new rectangular waveguide to coplanar waveguide transition," IEEE MTT-S, May 1990.

Grabherr, W., et al., "Microstrip to waveguide transition compatible with mm-wave integrated circuits," IEEE Transactions on Microwave Theory and Techniques, Sep. 1994.

Simon, W., et al., "A novel coplanar transmission line to rectangular waveguide transition," IEEE MTT-S, Jun. 1998.

Kaneda, N., et al., "A broad-band microstrip-to-waveguide transition using quasi-Yagi antenna," IEEE Transactions on Microwave Theory and Techniques, Dec. 1999. Dec. 1999.

Lin, T.H., Wu, R.B., "CPW to waveguide transition with tapered slotline probe," IEEE Microwave and Wireless Components Letters, Jul. 2001.

Lizuka, H., et al., "Millimeter-wave microstrip line to waveguide transition fabricated on a single layer dielectric substrate," IEICE Transactions on Communications, Jun. 2002.

* cited by examiner

*Primary Examiner* — Jany Richardson
(74) *Attorney, Agent, or Firm* — Parsons Behle & Latimer

(57) ABSTRACT

A low-profile apparatus for transitioning circular polarized electromagnetic waves to linear polarized electromagnetic waves when moving in a first direction and transitioning linear polarized electromagnetic waves to circular polarized electromagnetic waves when moving in a second direction. The apparatus includes a substrate with an electrical path positioned within the substrate. A first antenna element attached to the substrate is capacitively coupled to the electrical path and a second antenna element attached to the substrate is capacitively coupled to the electrical path. The apparatus includes a ground plane and electromagnetic waves propagate along the electrical path in a transverse electromagnetic mode. The first antenna element may be positioned within an interior of a first waveguide and the second antenna element may be positioned within an interior of a second waveguide. The first waveguide may have a circular cross-section and the second waveguide may have a rectangular cross-section.

20 Claims, 9 Drawing Sheets

LOW-PROFILE RECTANGULAR TO CIRCULAR TRANSITION

FIELD OF THE DISCLOSURE

The examples described herein relate to a low-profile apparatus for transitioning circular polarized electromagnetic waves to linear polarized electromagnetic waves when moving in a first direction and transitioning linear polarized electromagnetic waves to circular polarized electromagnetic waves when moving in a second direction.

BACKGROUND

Description of the Related Art

Waveguides are used in many radio frequency (RF) applications for low-loss signal propagation. The two most common forms of waveguides are rectangular and circular. It may be desired to transition electromagnetic waves between different propagation modes. For example, there are applications where it is desirable to transition from linear polarized electromagnetic waves to circular polarized electromagnetic waves. Likewise, there are applications where it is desirable to transition from circular polarized electromagnetic waves to linear polarized electromagnetic waves. Rectangular to circular waveguide transitions may be used to transition electromagnetic waves from circular polarized electromagnetic waves to linear polarized electromagnetic waves as the electromagnetic waves travel from a circular waveguide to a rectangular waveguide. Likewise, rectangular to circular waveguide transitions may be used to transition electromagnetic waves from linear polarized electromagnetic waves to circular polarized electromagnetic waves as the electromagnetic waves travel from a rectangular waveguide to a circular waveguide.

As an example, a circular polarized horn antenna, which is used to transmit and receive free-space electromagnetic waves, utilizes a circular waveguide to impedance match (i.e., minimize power loss) with the horn antenna. A circular to rectangular waveguide transition is further useful for transitioning to the RF electronics, which are either rectangular waveguide based or require a rectangular waveguide to coax transition.

Typical rectangular to circular waveguide transitions may be too large and/or may weigh too much to be useful in some applications. Rectangular to circular waveguide transitions are typically constructed by milling, or machining, a bulk piece of metal, such as brass, copper, silver, or aluminum to form the waveguide transition. Typically, the rectangular to circular waveguide transition includes a rectangular waveguide at one end, a circular waveguide at the other end, with a transition length in between with a common centerline axis along the apparatus. The transition length is typically at least a few inches between the waveguides on the ends. The dimensions of typical rectangular to circular waveguide transitions prevent their use in low-profile applications. Another disadvantage of typical rectangular to circular waveguide transitions includes weight and cost. Other disadvantages of typical rectangular to circular waveguide transitions may exist.

SUMMARY

The present disclosure is directed to a low-profile apparatus for transitioning circular polarized electromagnetic waves to linear polarized electromagnetic waves when moving in a first direction and transitioning linear polarized electromagnetic waves to circular polarized electromagnetic waves when moving in a second direction.

One example of the present disclosure is an apparatus including a substrate. The apparatus includes an electrical path positioned within the substrate. The apparatus includes a first antenna element attached to the substrate, the first antenna element is capacitively coupled to the electrical path. The apparatus includes a second antenna element attached to the substrate, the second antenna element is capacitively coupled to the electrical path. The apparatus includes a ground plane positioned on the substrate.

Electromagnetic waves propagate along the electrical path in a transverse electromagnetic mode (TEM). Electromagnetic waves transition from circular polarized electromagnetic waves to linear polarized electromagnetic waves when moving in a first direction from the first antenna element to the second antenna element. Electromagnetic waves transition from linear polarized electromagnetic waves to circular polarized electromagnetic waves when moving in a second direction from the second antenna element to the first antenna element.

The apparatus may include a first waveguide having a first interior, the first waveguide attached to the substrate, wherein the first antenna element is positioned within the first interior of the first waveguide. The apparatus may include a second waveguide having a second interior, the second waveguide attached to the substrate, wherein the second antenna element is positioned within the second interior of the second waveguide. The first waveguide having a first central axis and the second waveguide having a second central axis, wherein the second central axis may be offset from the first central axis. The substrate has a first surface and a second surface opposite of the first surface. The ground plane of the apparatus may further comprise a first ground plane positioned on the first surface of the substrate. The apparatus may include a second ground plane positioned on the second surface of the substrate and at least one via may electrically short the second ground plane to the first ground plane. The first antenna element may be positioned on the first surface of the substrate and the second antenna element may be positioned on the second surface of the substrate.

The first antenna element may be attached to the substrate and be positioned within a first interior of the first waveguide and the second antenna element may be attached to the substrate and be positioned within a second interior of the second waveguide. The first waveguide may have a circular cross-section. The first antenna element may be a circular antenna element. The second waveguide may have a rectangular cross-section. The second antenna element may be a rectangular antenna element. The electrical path may include a first microstrip, a second microstrip, and a stripline connected between the first microstrip and the second microstrip, wherein the first antenna element is capacitively coupled to the first microstrip and wherein the second antenna element is capacitively coupled to the second microstrip. The first antenna element may include a slot through the first antenna element. The substrate may be comprised of a plurality of layers and the electrical path may be positioned on an internal layer of the plurality of layers.

One example of the present disclosure is a method that includes providing a circular antenna element and a first ground plane on a top surface of a first layer. The method includes providing a second layer and providing an electrical path on a surface of a third layer. The method includes providing a rectangular antenna element and a second ground plane on a bottom surface of a fourth layer. The method includes bonding together the first layer, the second layer, the third layer, and the fourth layer to form a substrate, wherein the circular antenna element and the first ground plane are positioned on a first surface of the substrate and wherein the rectangular antenna element and the second ground plane are positioned on a second surface of the substrate, the second surface being opposite of the first surface.

The circular antenna element may be capacitively coupled to a first portion of the electrical path on the surface of the third layer and the rectangular antenna element may be capacitively coupled to a second portion of the electrical path on the surface of the third layer. The electrical path may include a first microstrip, a second microstrip, and a stripline connected between the first microstrip and the second microstrip. The first portion of the electrical path may be the first microstrip and the second portion of the electrical path may be the second microstrip. The method may include providing a plurality of vias through the substrate and providing conductive material within the plurality of vias, wherein the plurality of vias electrically short the first ground plane with the second ground plane. The method may include attaching a circular waveguide to the first surface of the substrate, wherein the circular waveguide encloses the circular antenna element. The method may include attaching a rectangular waveguide to the second surface of the substrate, wherein the rectangular waveguide encloses the rectangular antenna element.

The method may include providing the circular antenna element and the first ground plane on the top surface of the first layer comprises removing material from the first layer to form the circular antenna element and the first ground plane or comprises forming the circular antenna element and the first ground plane on the first layer by additive manufacturing. The method may include providing the electrical path on the surface of the third layer comprises removing material from the third layer to form the electrical path or comprises forming the electrical path on the third layer by additive manufacturing. The method may include providing the rectangular antenna element and the second ground plane on the bottom surface of the fourth layer comprises removing material from the fourth layer to form the rectangular antenna element and the second ground plane or comprises forming the rectangular antenna element and the second ground plane on the fourth layer by additive manufacturing.

One example of the present disclosure is a method that includes providing a circular antenna element and a rectangular antenna element on a surface of a first layer. The method includes providing a second layer and providing an electrical path on a surface of a third layer. The method includes providing a ground plane on a surface of a fourth layer. The method includes bonding together the first layer, the second layer, the third layer, and the fourth layer to form a substrate, wherein the circular antenna element and the rectangular antenna element are positioned on a first surface of the substrate and wherein the ground plane is positioned on a second surface of the substrate, the second surface being opposite of the first surface.

The circular antenna element may be capacitively coupled to the electrical path and the rectangular antenna element may be capacitively coupled to electrical path. The method may include attaching a circular waveguide to the first surface of the substrate, wherein the circular waveguide encloses the circular antenna element. The method may include attaching a rectangular waveguide to the first surface of the substrate, wherein the rectangular waveguide encloses the rectangular antenna element.

Figure 1:
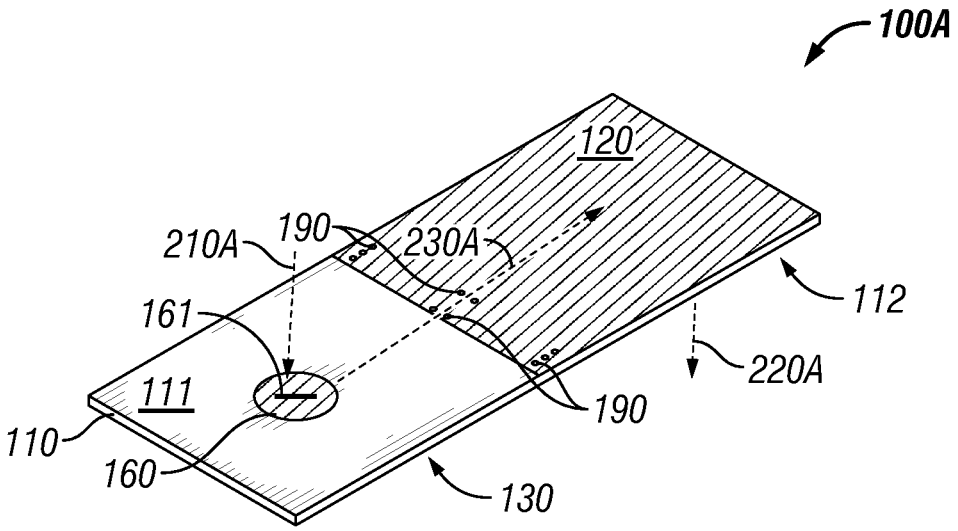
FIG. 1 is a schematic perspective view of an example of an apparatus for transitioning electromagnetic waves between different propagation modes.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the disclosure as defined by the appended claims.

DETAILED DESCRIPTION

As used herein, the terms "top," "bottom," "first," and "second" can refer to relative directions or positions of features in the apparatus shown in the Figures. These terms, however, should be construed broadly to include apparatus having other orientations, such as inverted or inclined orientations where top/bottom, over/under, above/below, up/down, and left/right can be interchanged depending on the orientation.

FIG. 1 shows an example of an apparatus 100A for transitioning electromagnetic waves between different propagation modes. For example, the apparatus 100A may transition electromagnetic waves between circular polarized electromagnetic waves and linear polarized electromagnetic waves. The apparatus 100A includes a substrate 110 having a first surface, or upper side, 111 and a second surface, or lower side, 112 opposite of the first surface 111. The apparatus 100A includes a first ground plane 120 located on a portion of the first surface 111 and a second ground plane 130 (best shown in FIG. 2) located on a portion of the second surface 112. One or more vias 190 electrically short the first ground plane 120 to the second ground plane 130. The one or more vias 190 may be filled with and/or plated with various conductive materials to provide an electrical connection between the first ground plane 120 and the second ground plane 130 as would be appreciated by one of ordinary skill in the art having the benefit of this disclosure.

The apparatus 100A includes a first antenna element 160 located on the first surface 111 of the substrate 110 and a second antenna element 170 (best shown in FIG. 2) located on the second surface 112 of the substrate 110. The apparatus 100A includes an electrical path 180 (best shown in FIG. 2) positioned within the substrate 110. The first antenna element 160 is capacitively coupled to the electrical path 180 and the second antenna element 170 is capacitively coupled to the electrical path 180.

Electromagnetic waves that travel in a first direction along the substrate 110 between the first and second antenna elements 160, 170 transition from a first propagation mode to a second propagation mode and electromagnetic waves that travel in a second direction along the substrate 110 between the first and second antenna elements 160, 170 transition from a second propagation mode to a first propagation mode. For example, as shown in FIG. 1, electromagnetic waves received by the first antenna element 160, shown by arrow 210A, are received as circular polarized electromagnetic waves. The electromagnetic waves propagate in a first direction along the electrical path 180 located within the substrate 110, shown by arrow 230A, to the second antenna element 170. The electromagnetic waves are transitioned to linear polarized electromagnetic waves at the second antenna element 170, which may be propagated to another device or system as shown by arrow 220A. The electromagnetic waves that travel in a second direction from the second antenna element 170 to the first antenna element 160 transition from linear polarized electromagnetic waves to circular polarized electromagnetic waves as discussed herein.

The first antenna element 160 of the apparatus 100A may be a circular antenna element that includes a slot 161 through the first antenna element 160. The slot 161 is configured to cause the electromagnetic waves to rotate around the first antenna element 160 resulting in circular polarization. The dimensions of the first antenna element 160, the slot 161 in the first antenna element 160, and the second antenna element 170 may be configured to maximize signal propagation at a desired operating frequency as would be appreciated by one of ordinary skill in the art having the benefit of this disclosure.

Figure 2:
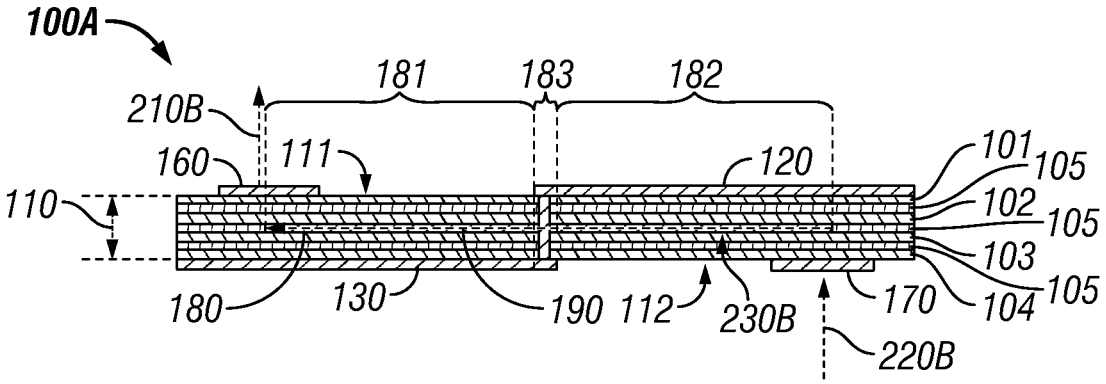
FIG. 2 is a schematic cross-sectional view of an example of an apparatus for transitioning electromagnetic waves between different propagation modes.

FIG. 2 shows a schematic cross-section view of an apparatus 100A for transitioning electromagnetic waves between different propagation modes. The apparatus 100A includes a substrate 110 having a first surface, or upper side, 111 and a second surface, or lower side, 112 opposite of the first surface 111. The substrate 110 may be comprised of various layers bonded together to form the substrate 110. For example, the substrate 110 may include a first layer 101, a second layer 102, a third layer 103, and a fourth layer 104 each bonded together by an adhesive, bonding, and/or laminating material 105. The substrate 110 may include more or less than four layers as would be appreciated by one or ordinary skill in the art having the benefit of this disclosure.

The apparatus 100A includes a first ground plane 120 located on a portion of the first surface 111 and a second ground plane 130 located on a portion of the second surface 112. One or more vias 190 electrically short the first ground plane 120 to the second ground plane 130 as discussed herein. While the one or more vias 190 electrically short the first ground plane 120 to the second ground plane 130, the one or more vias 190 are not electrically shorted to the electrical path 180 through the substrate 110. Likewise, the one or more vias 190 are not electrically shorted to the first antenna element 160 nor the second antenna element 170.

The apparatus 100A includes a first antenna element 160 located on the first surface 111 of the substrate 110 and a second antenna element 170 located on the second surface 112 of the substrate 110. The apparatus 100A includes an electrical path 180 positioned within the substrate 110. The electrical path 180 may be comprised of a first microstrip 181, a second microstrip 182, and a stripline 183 connected between the first microstrip 181 and the second microstrip 182. As used herein, a microstrip is an electrical path that has a single ground plane above or below the microstrip. A stripline is an electrical path that is positioned between two ground planes. The stripline 183 portion of the electrical path 180 is the portion of the electrical path 180 that is positioned between an area of overlap of the first and second ground planes 120, 130. The first antenna element 160 is capacitively coupled to the first microstrip 181 and the second antenna element 170 is capacitively coupled to the second microstrip 182.

As discussed herein, electromagnetic waves that travel in a second direction along the substrate 110 between the second and first antenna elements 160, 170 transition from a second propagation mode to a first propagation mode. For example, as shown in FIG. 2, electromagnetic waves received by the second antenna element 170, shown by arrow 220B, are received as linear polarized electromagnetic waves. The electromagnetic waves propagate in a second direction along the electrical path 180 located within the substrate 110, shown by arrow 230B, to the first antenna element 160. The electromagnetic waves are transitioned to circular polarized electromagnetic waves at the first antenna element 160, which may be propagated to another device or system as shown by arrow 220B.

The electromagnetic waves, whether they are linear polarized electromagnetic waves or circular polarized electromagnetic waves, that are received by and propagated from the first and second antenna elements 160, 170 propagate in transverse electric (TE) mode through a waveguide. Electromagnetic waves in TE modes have no electric field in the direction of propagation. The electromagnetic waves transition from TE mode to transverse electromagnetic (TEM) mode as the electromagnetic waves propagate along the electrical path 180 in either direction. Electromagnetic waves in TEM mode have neither electric nor magnetic fields in the direction of propagation. Typical rectangular to circular waveguide transitions do not transition the electromagnetic waves from TE mode to TEM mode and back to TE mode. Rather, the electromagnetic waves remain in TE mode as they travel between the collinear waveguides of the transition.

Figure 3:
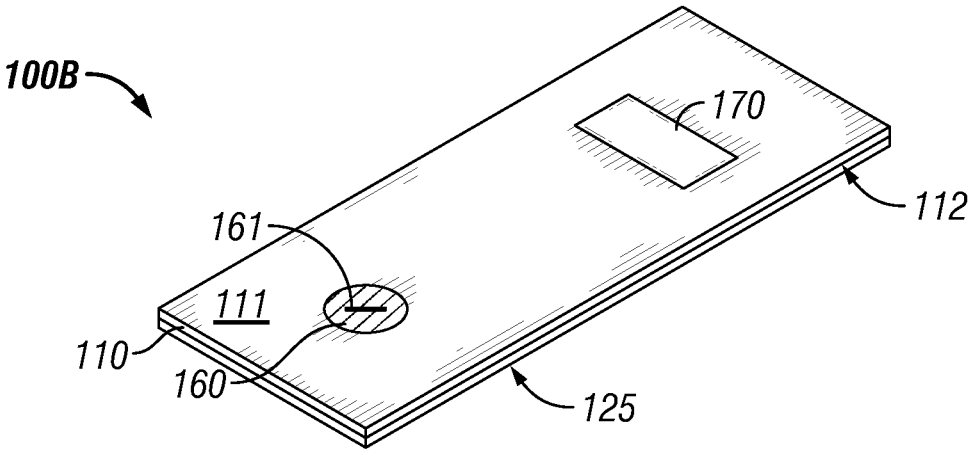
FIG. 3 is a schematic perspective view of an example of an apparatus for transitioning electromagnetic waves between different propagation modes.

FIG. 3 shows an example of an apparatus 100B for transitioning electromagnetic waves between different propagation modes. The apparatus 100B may be used to transition electromagnetic waves between circular polarized electromagnetic waves and linear polarized electromagnetic waves. The apparatus 100B includes a substrate 110 having a first surface, or upper side, 111 and a second surface, or lower side, 112 opposite of the first surface 111. The apparatus 100B includes a ground plane 125 (shown in FIG. 4) located on the second surface 112.

The apparatus 100B includes a first antenna element 160 located on the first surface 111 of the substrate 110 and a second antenna element 170 also located on the first surface 111 of the substrate 110. The apparatus 100B includes an electrical path 184 (shown in FIG. 4) positioned within the substrate 110. The first antenna element 160 is capacitively coupled to the electrical path 184 and the second antenna element 170 is also capacitively coupled to the electrical path 184. The electrical path 184 may be a microstrip positioned within the substrate 110.

Electromagnetic waves that travel in a first direction along the substrate 110 between the first and second antenna elements 160, 170 transition from a first propagation mode to a second propagation mode and electromagnetic waves that travel in a second direction along the substrate 110 between the first and second antenna elements 160, 170 transition from a second propagation mode to a first propagation mode. For example, electromagnetic waves received by the first antenna element 160 may be received as circular polarized electromagnetic waves, propagate in a first direction along the electrical path 184, and transition to linear polarized electromagnetic waves at the second antenna element 170. Likewise, electromagnetic waves received by the second antenna element 170 may be received as linear polarized electromagnetic waves, propagate in a second direction along the electrical path 184, and transition to circular polarized electromagnetic waves at the first antenna element 160.

The first antenna element 160 of the apparatus 100B may be a circular antenna element that includes a slot 161 through the first antenna element 160. The slot 161 is configured to cause the electromagnetic waves to rotate around the first antenna element 160 resulting in circular polarization. The dimensions of the first antenna element 160, the slot 161 in the first antenna element 160, and the second antenna element 170 may be configured to maximize signal propagation at a desired operating frequency as would be appreciated by one of ordinary skill in the art having the benefit of this disclosure.

Figure 4:
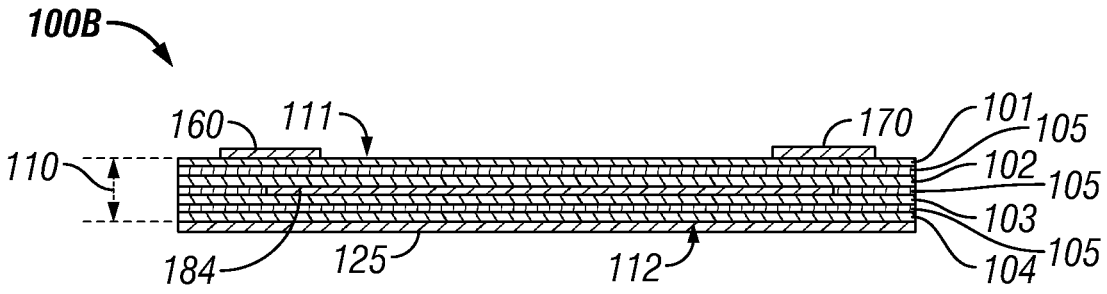
FIG. 4 is a schematic cross-sectional view of an example of an apparatus for transitioning electromagnetic waves between different propagation modes.

FIG. 4 shows a schematic cross-section view of an apparatus 100B for transitioning electromagnetic waves between different propagation modes. The apparatus 100B includes a substrate 110 having a first surface, or upper side, 111 and a second surface, or lower side, 112 opposite of the first surface 111. The substrate 110 may be comprised of various layers bonded together to form the substrate 110. For example, the substrate 110 may include a first layer 101, a second layer 102, a third layer 103, and a fourth layer 104 each bonded together by an adhesive, bonding, and/or laminating material 105. The substrate 110 may include more or less than four layers as would be appreciated by one or ordinary skill in the art having the benefit of this disclosure.

The apparatus 100B includes a ground plane 125 located on the second surface 112. The apparatus 100B includes a first antenna element 160 located on the first surface 111 of the substrate 110 and a second antenna element 170 also located on the first surface 111 of the substrate 110. The apparatus 100B includes an electrical path 184 positioned within the substrate 110. The entire electrical path 184 is a microstrip. The first antenna element 160 is capacitively coupled to the electrical path 184 and the second antenna element 170 is also capacitively coupled to the electrical path 184.

Figure 5:
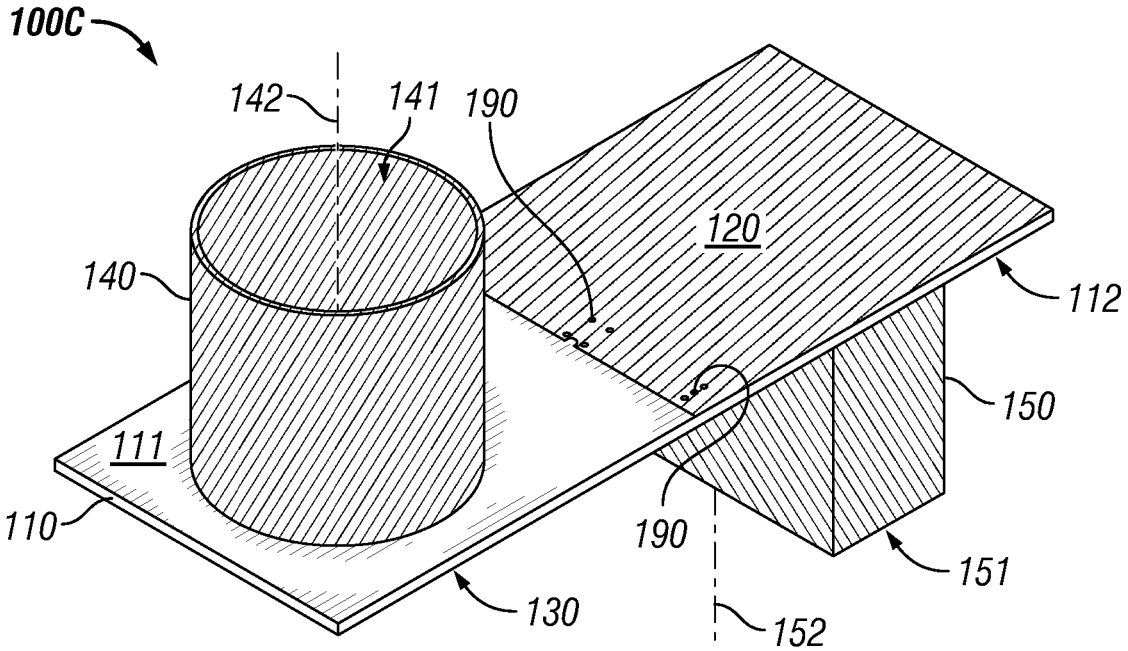
FIG. 5 is a schematic perspective view of an example of an apparatus for transitioning electromagnetic waves between different propagation modes.

FIG. 5 shows an example of an apparatus 100C for transitioning electromagnetic waves between different propagation modes. For example, the apparatus 100C may transition electromagnetic waves between circular polarized electromagnetic waves and linear polarized electromagnetic waves. The apparatus 100C includes a substrate 110 having a first surface, or upper side, 111 and a second surface, or lower side, 112 opposite of the first surface 111. The apparatus 100C includes a first ground plane 120 located on a portion of the first surface 111 and a second ground plane 130 located on a portion of the second surface 112. One or more vias 190 electrically short the first ground plane 120 to the second ground plane 130. The one or more vias 190 may be filled with and/or plated with various conductive materials to provide an electrical connection between the first ground plane 120 and the second ground plane 130 as would be appreciated by one of ordinary skill in the art having the benefit of this disclosure.

The apparatus 100C includes a first waveguide 140 located on the first surface 111 of the substrate 110 and a second waveguide 150 located on the second surface 112 of the substrate 110. The first waveguide 140 has a first interior 141 and a first central axis 142. The second waveguide 150 has a second interior 151 and a second central axis 152. The first central axis 142 is offset from the second central axis 152.

The apparatus 100C includes a first antenna element 160 located on the first surface 111 of the substrate 110 within the first interior 141 of the first waveguide 140. In other words, the first waveguide 140 encloses or encircles the first antenna element 160. The apparatus 100C includes a second antenna element 170 located on the second surface 112 of the substrate 110 within the second interior 151 of the second waveguide 150. In other words, the second waveguide encloses or encircles the second antenna element 170. The apparatus 100C includes an electrical path 180 positioned within the substrate 110. The first antenna element 160 is capacitively coupled to the electrical path 180 and the second antenna element 170 is capacitively coupled to the electrical path 180.

As discussed herein, electromagnetic waves that travel in a first direction along the substrate 110 between the first and second antenna elements 160, 170 transition from a first propagation mode to a second propagation mode and electromagnetic waves that travel in a second direction along the substrate 110 between the first and second antenna elements 160, 170 transition from a second propagation mode to a first propagation mode. The first direction is opposite of the second direction. For example, electromagnetic waves received by the first waveguide 140 and the first antenna element 160 are received as circular polarized electromagnetic waves. The electromagnetic waves then propagate in a first direction along the electrical path 180 located within the substrate 110. The electromagnetic waves are then transitioned to linear polarized electromagnetic waves at the second antenna element 170, which then propagate out of the second waveguide 150. The electromagnetic waves that travel in a second direction from the second waveguide 150 and second antenna element 170 to the first antenna element 160 and first waveguide 140 transition from linear polarized electromagnetic waves to circular polarized electromagnetic waves as discussed herein.

The first waveguide 140 may have a circular cross-section and the second waveguide 150 may have a rectangular cross-section. The first antenna element 160 of the apparatus 100C may be a circular antenna element that includes a slot 161 through the first antenna element 160. The slot 161 is configured to cause the electromagnetic waves to rotate around the first antenna element 160 resulting in circular polarization. The dimensions of the first waveguide 140, the first antenna element 160, the slot 161 in the first antenna element 160, the second antenna element 170, and the second waveguide 150 may be configured to maximize signal propagation at a desired operating frequency as would be appreciated by one of ordinary skill in the art having the benefit of this disclosure.

Figure 6A:
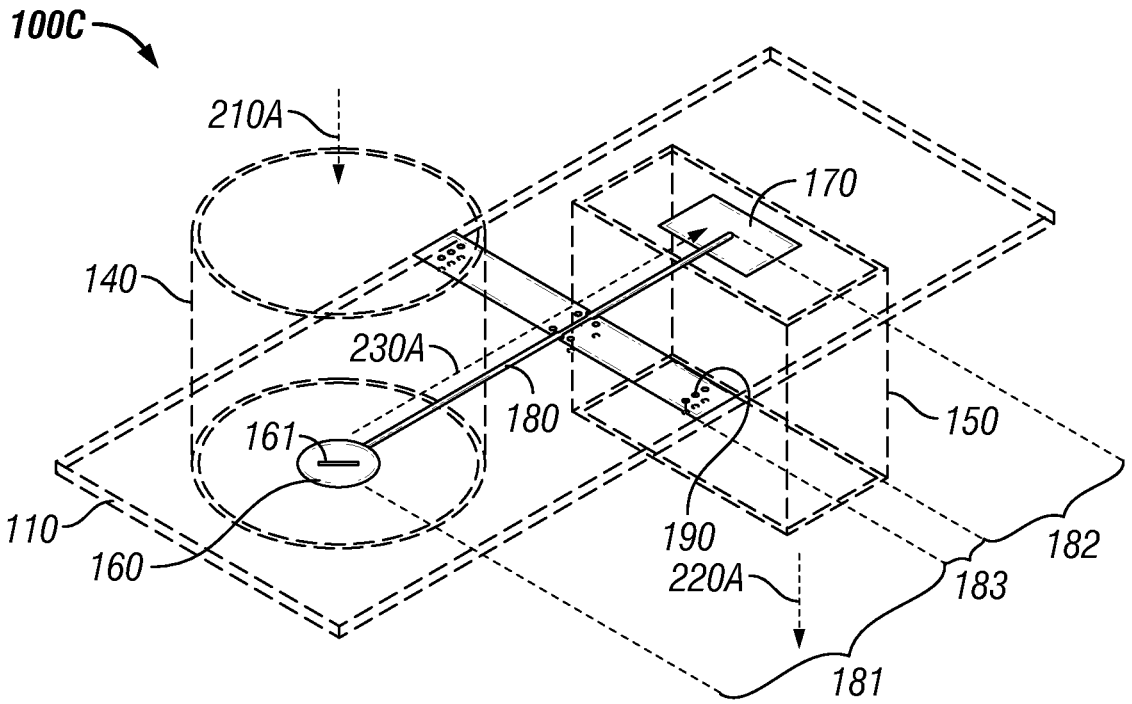
FIG. 6A is a transparent perspective view of an example of an apparatus for transitioning electromagnetic waves showing circular polarized electromagnetic waves transitioning to linear polarized electromagnetic waves.

FIG. 6A is a transparent perspective view of an example of an apparatus 100C for transitioning electromagnetic waves between propagation modes. The apparatus 100C is shown in a transparent perspective view for clarity. The apparatus 100C includes a substrate 110 having a first antenna element 160 and a first waveguide 140 attached to a first surface of the substrate 110 and a second antenna element 170 and a second waveguide 150 attached to a second surface of the substrate 110. The first antenna element 160 is a circular antenna element with a slot 161 through the circular antenna element. The second antenna element 170 is a rectangular antenna element. The first waveguide 140 has a circular cross-section and the second waveguide 150 has a rectangular cross-section.

The first antenna element 160 is capacitively coupled to an electrical path 180 positioned within the substrate 110. The second antenna element 170 is also capacitively coupled to the electrical path 180 positioned within the substrate 110. Specifically, the first antenna element 160 is capacitively coupled to a first microstrip 181 of the electrical path 180 and the second antenna element 170 is capacitively coupled to a second microstrip 182 of the electrical path 180. A stripline 183 connects the first microstrip 181 with the second microstrip 182. As discussed herein, the stripline 183 is the portion of the electrical path that is positioned between two ground planes 120, 130 (shown in FIG. 5) that are electrically shorted by one or more vias 190.

FIG. 6A shows the transition of circular polarized electromagnetic waves to linear polarized electromagnetic waves. Circular polarized electromagnetic waves enter the first waveguide 140 as indicated arrow 210A and propagate to the first antenna element 160. The circular polarized electromagnetic waves propagate in TE mode as discussed herein. The first antenna element 160 is capacitively coupled to the electrical path 180. As the waves propagate along the electrical path 180 as shown by arrow 230A the electromagnetic waves transition to TEM mode as discussed herein. When the electromagnetic waves reach the end of the electrical path 180 the electromagnetic waves transition back to TE mode as the second antenna element 170 is capacitively coupled to the end of the electrical path 180. The second antenna element 170, which is a rectangular antenna element, and the second waveguide 150, which has a rectangular cross-section, transition the electromagnetic waves into linear polarized electromagnetic waves as indicated by 220A.

Figure 6B:
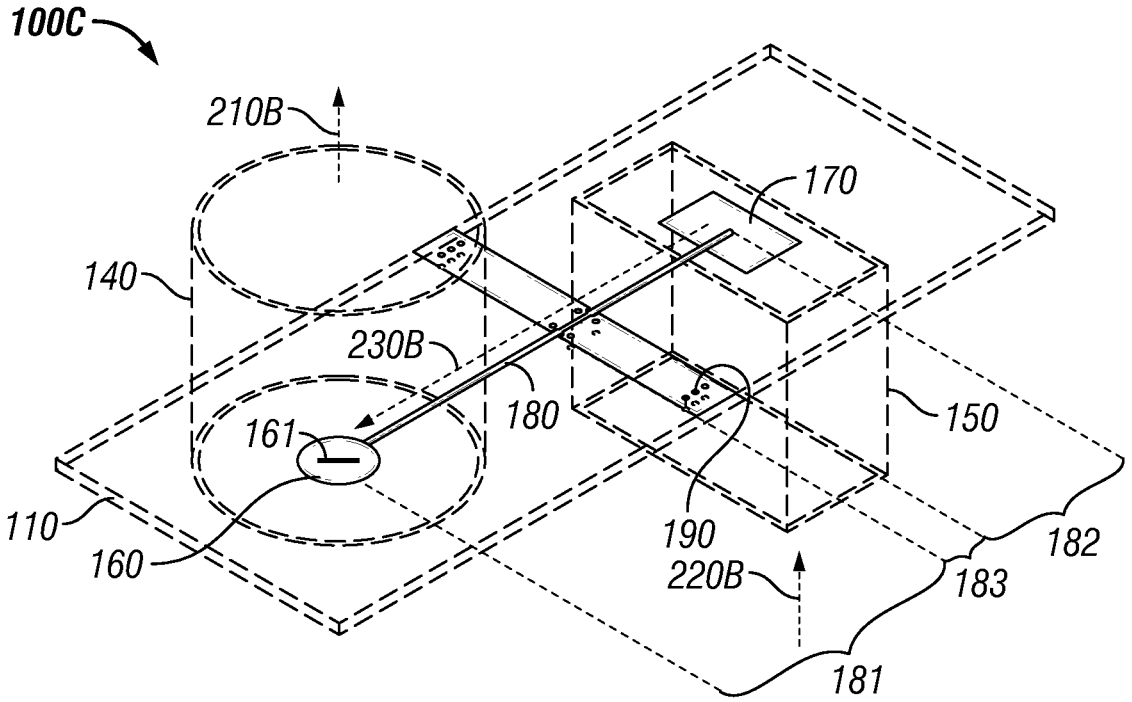
FIG. 6B is a transparent perspective view of an example of an apparatus for transitioning electromagnetic waves showing linear polarized electromagnetic waves transitioning to circular polarized electromagnetic waves.

FIG. 6B is a transparent perspective view of an example of an apparatus 100C for transitioning electromagnetic waves between propagation modes. The apparatus 100C is shown in a transparent perspective view for clarity. The apparatus 100C includes a substrate 110 having a first antenna element 160 and a first waveguide 140 attached to a first surface of the substrate 110 and a second antenna element 170 and a second waveguide 150 attached to a second surface of the substrate 110. The first antenna element 160 is a circular antenna element with a slot 161 through the circular antenna element. The second antenna element 170 is a rectangular antenna element. The first waveguide 140 has a circular cross-section and the second waveguide 150 has a rectangular cross-section.

The first antenna element 160 is capacitively coupled to an electrical path 180 positioned within the substrate 110. The second antenna element 170 is also capacitively coupled to the electrical path 180 positioned within the substrate 110. Specifically, the first antenna element 160 is capacitively coupled to a first microstrip 181 of the electrical path 180 and the second antenna element 170 is capacitively coupled to a second microstrip 182 of the electrical path 180. A stripline 183 connects the first microstrip 181 with the second microstrip 182. As discussed herein, the stripline 183 is the portion of the electrical path that is positioned between two ground planes 120, 130 (shown in FIG. 5) that are electrically shorted by one or more vias 190.

FIG. 6B shows the transition of linear polarized electromagnetic waves to circular polarized electromagnetic waves. Linear polarized electromagnetic waves enter the second waveguide 150 as indicated arrow 220B and propagate to the second antenna element 170. The linear polarized electromagnetic waves propagate in TE mode as discussed herein. The second antenna element 170 is capacitively coupled to the electrical path 180. As the waves propagate along the electrical path 180 as shown by arrow 230B the electromagnetic waves transition to TEM mode as discussed herein. When the electromagnetic waves reach the end of the electrical path 180 the electromagnetic waves transition back to TE mode as the first antenna element 160 is capacitively coupled to the end of the electrical path 180. The first antenna element 160, which is a circular antenna element, and the first waveguide 140, which has a circular cross-section, transition the electromagnetic waves into circular polarized electromagnetic waves as indicated by 210B.

As discussed herein, the substrate 110 of an apparatus (100A, 100B, and 100C) for transitioning electromagnetic waves between different propagation modes may be comprised of a plurality of layers bonded together. FIGS. 7A-7G show various layers and the bonding of layers to form an apparatus 100A (shown in FIG. 7F) or an apparatus 100C (shown in FIG. 7G) that transitions electromagnetic waves between propagation modes.

Figure 7A:
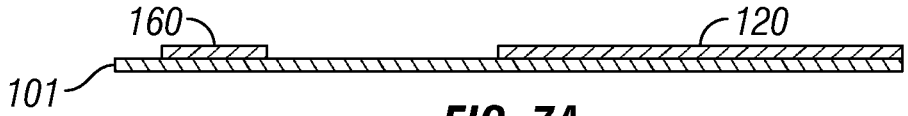
FIG. 7A is a schematic cross-section view of an example of a first layer including an antenna element and a ground plane.
Figure 7B:
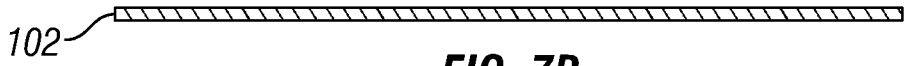
FIG. 7B is a schematic cross-section view of an example of a second layer.
Figure 7C:
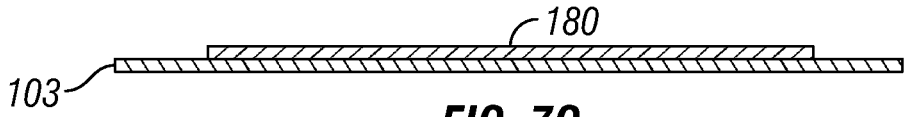
FIG. 7C is a schematic cross-section view of an example of a third layer including an electrical path.
Figure 7D:
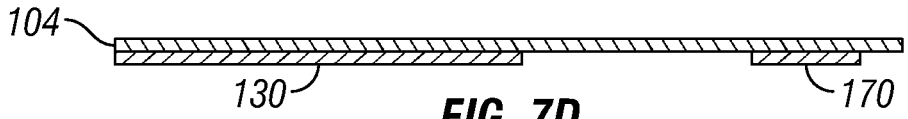
FIG. 7D is a schematic cross-section view of an example of a fourth layer including an antenna element and a ground plane.

FIG. 7A is a schematic cross-section view of an example of a first layer 101 including a first antenna element 160 and a first ground plane 120. FIG. 7B is a schematic cross-section view of an example of a second layer 102. FIG. 7C is a schematic cross-section view of an example of a third layer 103 that includes an electrical path 180. The electrical path 180 may be comprised of a stripline connected between two microstrips, may be a single microstrip, or the like. FIG. 7D is a schematic cross-section view of an example of a fourth layer 104 including a second antenna element 170 and a second ground plane 130.

Figure 7E:
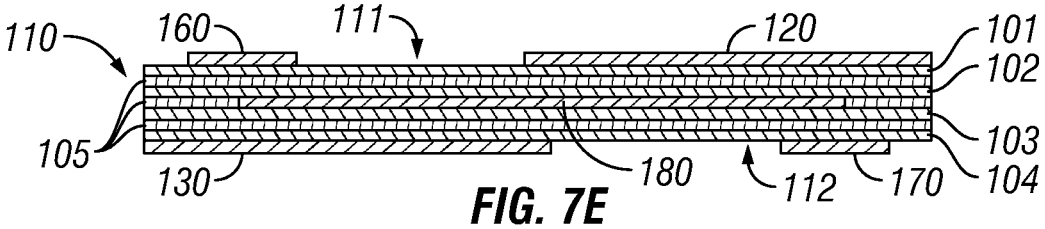
FIG. 7E is a schematic cross-section view of an example a first layer, second layer, third layer, and a fourth layer bonded together to form a substrate.

FIG. 7E is a schematic cross-section view of an example substrate 110 formed from bonding together the first layer 101, the second layer 102, the third layer 103, and the fourth layer 104. The layers 101-104 may be bonded together via layers of adhesive, bonding material, or laminated material 105 as would be appreciated by one of ordinary skill in the art having the benefit of this disclosure. More or less layers may be used to form a substrate 110 as would be appreciated by one of ordinary skill in the art having the benefit of this disclosure.

Figure 7F:
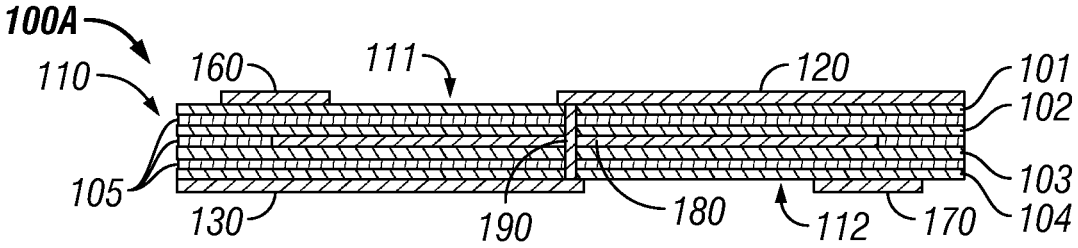
FIG. 7F is a schematic cross-section view of an example of an apparatus for transitioning electromagnetic waves between different propagation modes.

FIG. 7F is a schematic cross-section view of an example of an apparatus 100A for transitioning electromagnetic waves between different propagation modes. The substrate 110 includes one or more vias 190 that electrically short the first ground plane 120 to the second ground plane 130. The electrical path 180 includes a first microstrip connected to a second microstrip via a stripline. The stripline is the portion of the electrical path 180 that is positioned between the first ground plane 120 and the second ground plane 130. As discussed herein, the apparatus 100A may be used to transition electromagnetic waves between linear polarized electromagnetic waves and circular polarized electromagnetic waves depending on the direction of propagation along the electrical path 180 within the substrate 110.

Figure 7G:
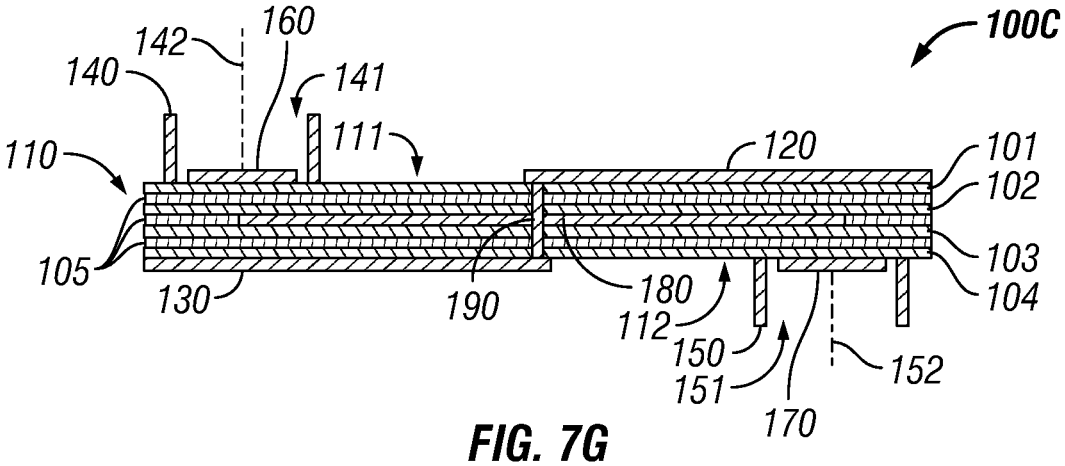
FIG. 7G is a schematic cross-section view of an example of an apparatus for transitioning electromagnetic waves between different propagation modes.

FIG. 7G is a schematic cross-section view of an example of an apparatus 100C for transitioning electromagnetic waves between different propagation modes. The apparatus 100C includes a first waveguide 140 attached to the first surface 111 of the substrate 110 and a second waveguide 150 attached to the second surface 112 of the substrate. The first antenna element 160 is positioned within the first waveguide 140 and the second antenna element 170 is positioned within the second waveguide 150. The substrate 110 includes one or more vias 190 that electrically short the first ground plane 120 to the second ground plane 130. The electrical path 180 includes a first microstrip connected to a second microstrip via a stripline. The stripline is the portion of the electrical path 180 that is positioned between the first ground plane 120 and the second ground plane 130. As discussed herein, the apparatus 100C may be used to transition electromagnetic waves between linear polarized electromagnetic waves and circular polarized electromagnetic waves depending on the direction of propagation along the electrical path 180 within the substrate 110.

Figure 8:
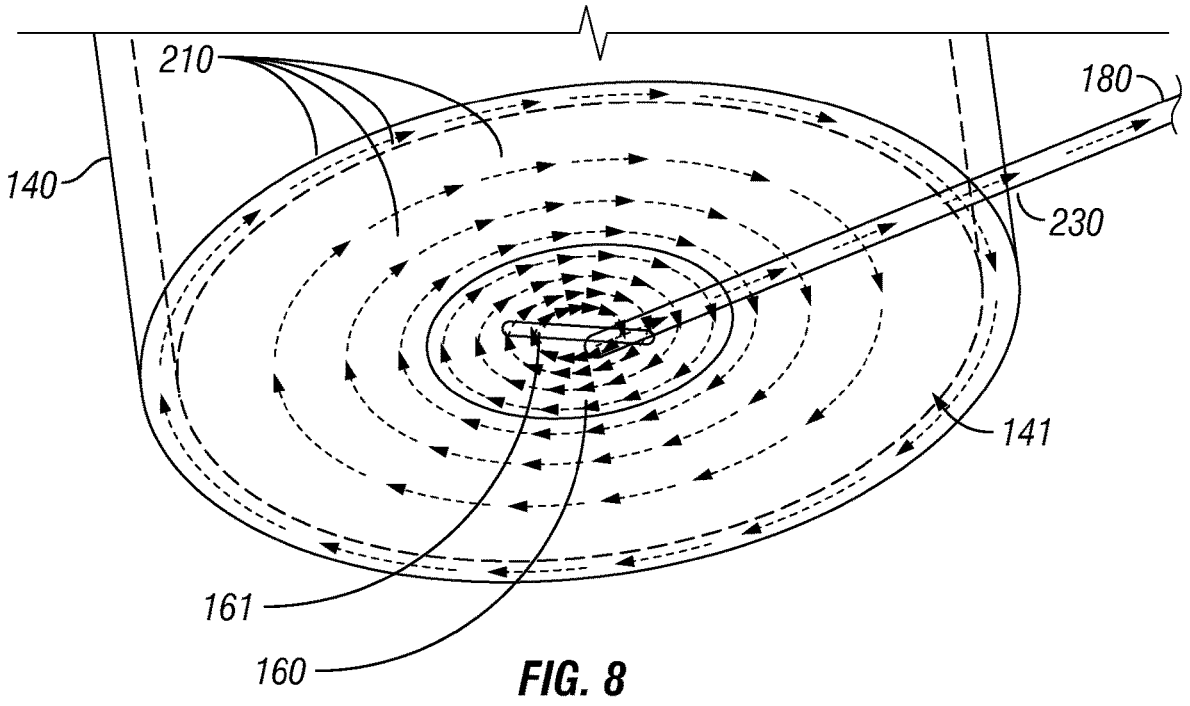
FIG. 8 is a transparent perspective view showing circular polarized electromagnetic waves transitioning to a transverse electromagnetic mode along an electrical path.

FIG. 8 is a transparent perspective view for clarity showing circular polarized electromagnetic waves transitioning to a transverse electromagnetic mode along an electrical path. Circular polarized electromagnetic waves travel down the first waveguide 140 and reach the first antenna element 160, which is a circular antenna element that includes a slot 161, as shown by arrows 210. The circular polarized electromagnetic waves 210 are in TE mode as discussed herein. The electromagnetic waves propagate to the electrical path 180, which is capacitively coupled to the first antenna element 160 as discussed herein. The electromagnetic waves transition to TEM modes as the electromagnetic waves propagate along the electrical path 180 as indicated by arrows 230.

Figure 9:
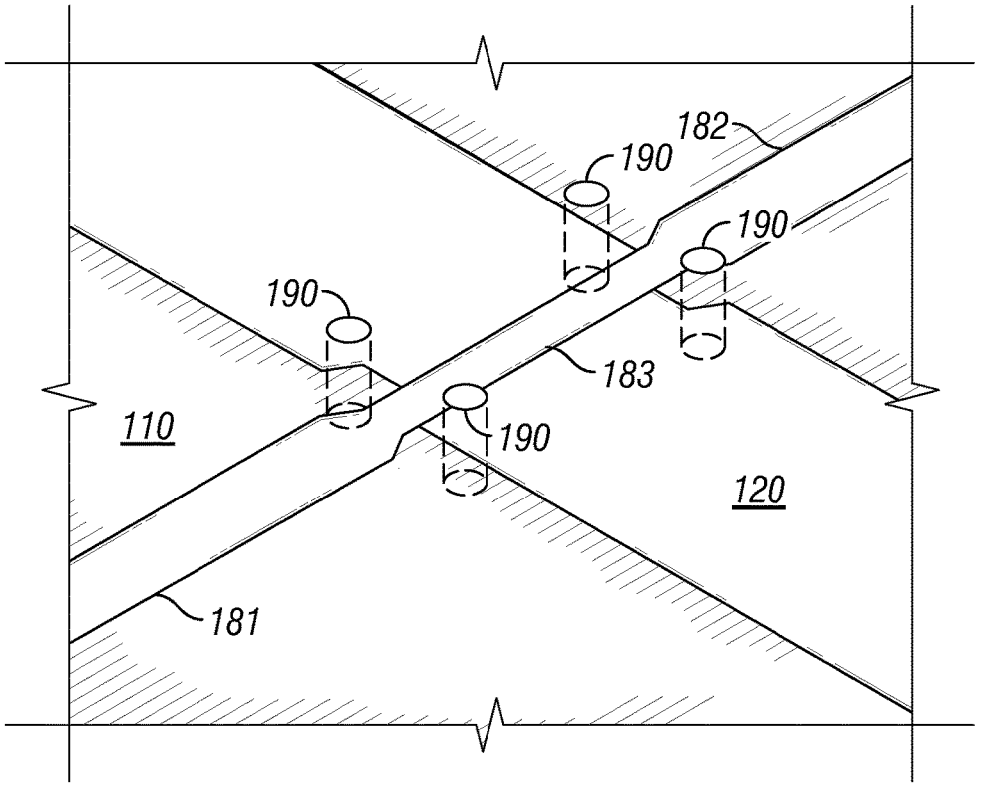
FIG. 9 is a transparent perspective view of a portion of an example of an apparatus for transitioning electromagnetic waves between different propagation modes.

FIG. 9 is a transparent perspective view for clarity of a portion of a substrate 110 of an apparatus for transitioning electromagnetic waves between different propagation modes. The substrate 110 includes an internal electrical path 180 (best shown in FIG. 7C) that is comprised of a first microstrip 181, a second microstrip 182, and a stripline 183 that connects the first microstrip 181 to the second microstrip 182. FIG. 9 shows a plurality of vias 190 that electrically short a first ground plane 120 to a second ground plane 130 (best shown in FIG. 7F).

Figure 10:
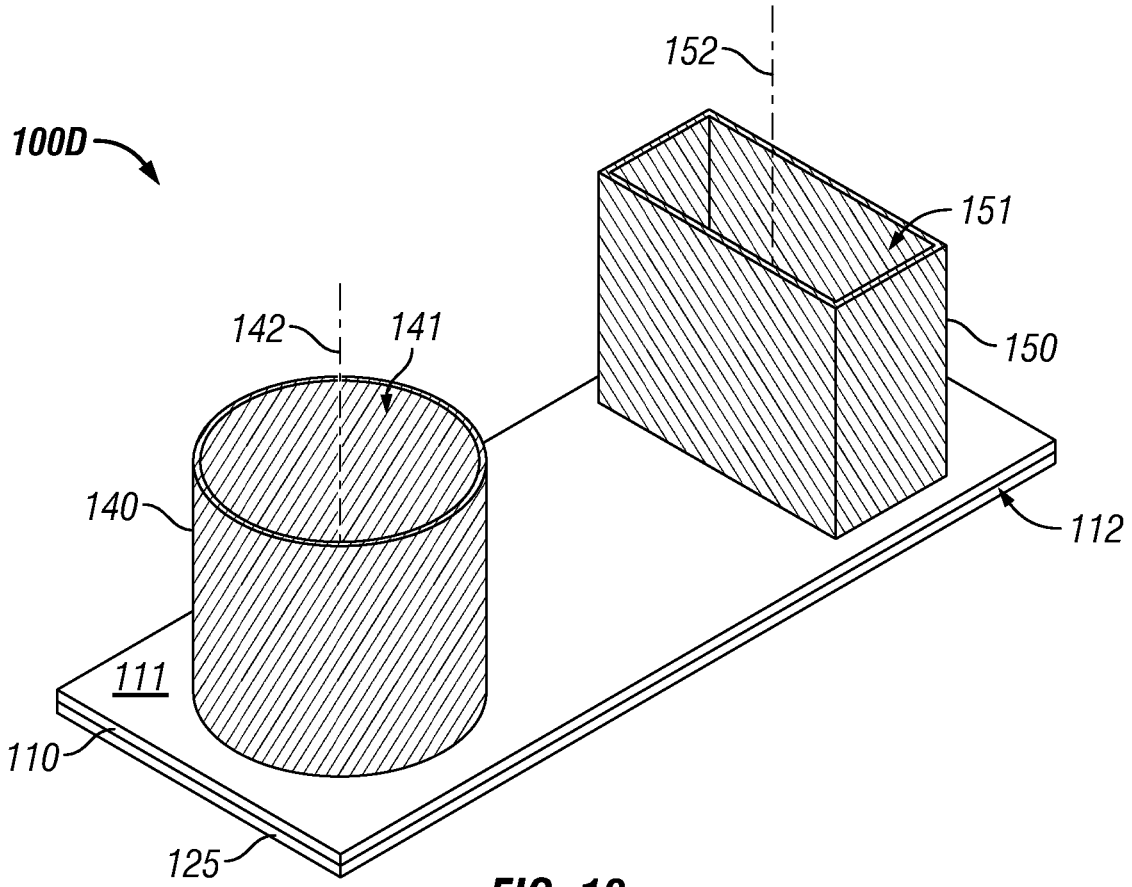
FIG. 10 is a schematic perspective view of an example of an apparatus for transitioning electromagnetic waves between different propagation modes.

FIG. 10 is a schematic perspective view an example of an apparatus 100D for transitioning electromagnetic waves between different propagation modes. For example, the apparatus 100D may transition electromagnetic waves between circular polarized electromagnetic waves and linear polarized electromagnetic waves. The apparatus 100D includes a substrate 110 having a first surface, or upper side, 111 and a second surface, or lower side, 112 opposite of the first surface 111. The apparatus 100D includes a ground plane 125 located on the second surface 112.

The apparatus 100D includes a first waveguide 140 located on the first surface 111 of the substrate 110 and a second waveguide 150 also located on the first surface 111 of the substrate 110. The first waveguide 140 has a first interior 141 and a first central axis 142. The second waveguide 150 has a second interior 151 and a second central axis 152. The first central axis 142 is offset from the second central axis 152.

The apparatus 100D includes a first antenna element 160 located on the first surface 111 of the substrate 110 within the interior 141 of the first waveguide 140. In other words, the first waveguide 140 encloses or encircles the first antenna element 160. The apparatus 100D includes a second antenna element 170 located on the first surface 111 of the substrate 110 within the interior 151 of the second waveguide 150. In other words, the second waveguide 150 encloses or encircles the second antenna element 170. The apparatus 100D includes an electrical path 180 positioned within the substrate 110. The first antenna element 160 is capacitively coupled to the electrical path 180 and the second antenna element 170 is capacitively coupled to the electrical path 180.

As discussed herein, electromagnetic waves that travel in a first direction along the substrate 110 between the first and second antenna elements 160, 170 transition from a first propagation mode to a second propagation mode and electromagnetic waves that travel in a second direction along the substrate 110 between the first and second antenna elements 160, 170 transition from a second propagation mode to a first propagation mode. For example, electromagnetic waves received by the first waveguide 140 and the first antenna element 160 are received as circular polarized electromagnetic waves. The electromagnetic waves then propagate in a first direction along the electrical path 180 located within the substrate 110. The electromagnetic waves are then transitioned to linear polarized electromagnetic waves at the second antenna element 170, which then propagate out of the second waveguide 150. The electromagnetic waves that travel in a second direction from the second waveguide 150 and second antenna element 170 to the first antenna element 160 and first waveguide 140 transition from linear polarized electromagnetic waves to circular polarized electromagnetic waves as discussed herein.

The first waveguide 140 may have a circular cross-section and the second waveguide 150 may have a rectangular cross-section. The first antenna element 160 of the apparatus 100D may be a circular antenna element that includes a slot 161 through the first antenna element 160. The slot 161 is configured to cause the electromagnetic waves to rotate around the first antenna element 160 resulting in circular polarization. The dimensions of the first waveguide 140, the first antenna element 160, the slot 161 in the first antenna element 160, the second antenna element 170, and the second waveguide 150 may be configured to maximize signal propagation at a desired operating frequency as would be appreciated by one of ordinary skill in the art having the benefit of this disclosure.

Figure 11A:
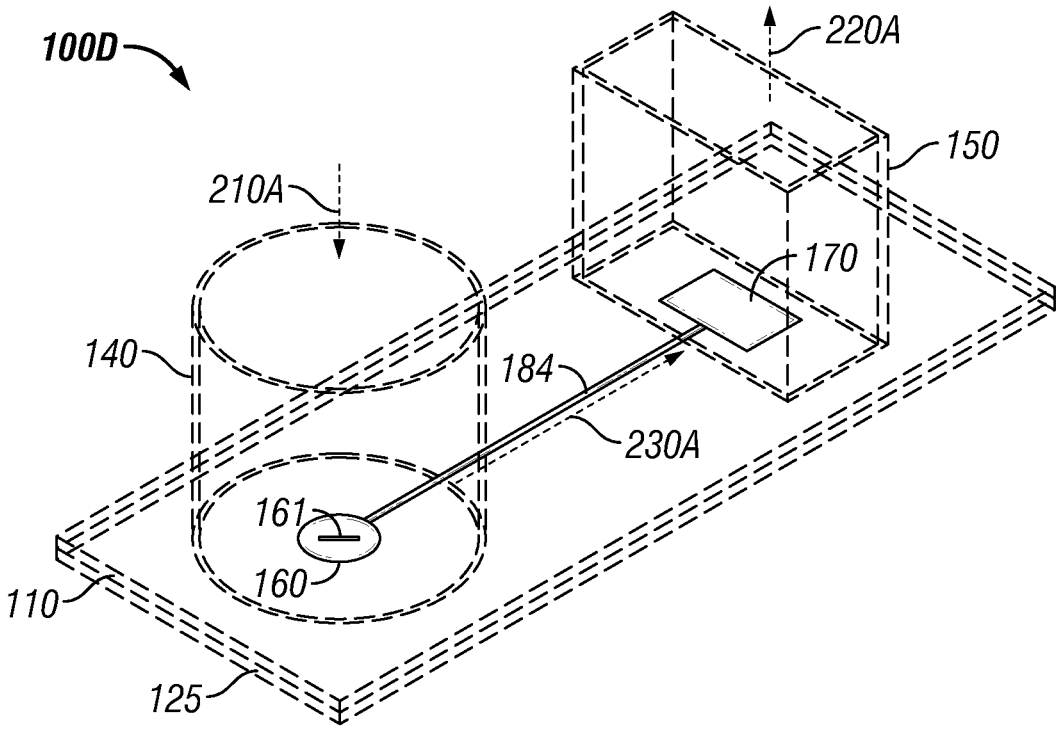
FIG. 11A is a transparent perspective view of an example of an apparatus for transitioning electromagnetic waves between different propagation modes.

FIG. 11A is a transparent perspective view of an example of an apparatus 100D for transitioning electromagnetic waves between propagation modes. The apparatus 100D is shown in a transparent perspective view for clarity. The apparatus 100D includes a substrate 110 having a first antenna element 160, a first waveguide 140, a second antenna element 170, and a second waveguide 150 each attached to a surface of the substrate 110. The first antenna element 160 is a circular antenna element with a slot 161 through the circular antenna element. The second antenna element 170 is a rectangular antenna element. The first waveguide 140 has a circular cross-section and the second waveguide 150 has a rectangular cross-section. The first antenna element 160 is capacitively coupled to an electrical path 184 positioned within the substrate 110. The second antenna element 170 is also capacitively coupled to the electrical path 184 positioned within the substrate 110.

FIG. 11A shows the transition of circular polarized electromagnetic waves to linear polarized electromagnetic waves. Circular polarized electromagnetic waves enter the first waveguide 140 as indicated arrow 210A and propagate to the first antenna element 160. The circular polarized electromagnetic waves propagate in TE mode as discussed herein. The first antenna element 160 is capacitively coupled to the electrical path 184. As the waves propagate along the electrical path 184 as shown by arrow 230A the electromagnetic waves transition to TEM mode as discussed herein. When the electromagnetic waves reach the end of the electrical path 184 the electromagnetic waves transition back to TE mode as the second antenna element 170 is capacitively coupled to the end of the electrical path 184. The second antenna element 170, which is a rectangular antenna element, and the second waveguide 150, which has a rectangular cross-section, transition the electromagnetic waves into linear polarized electromagnetic waves as indicated by 220A.

Figure 11B:
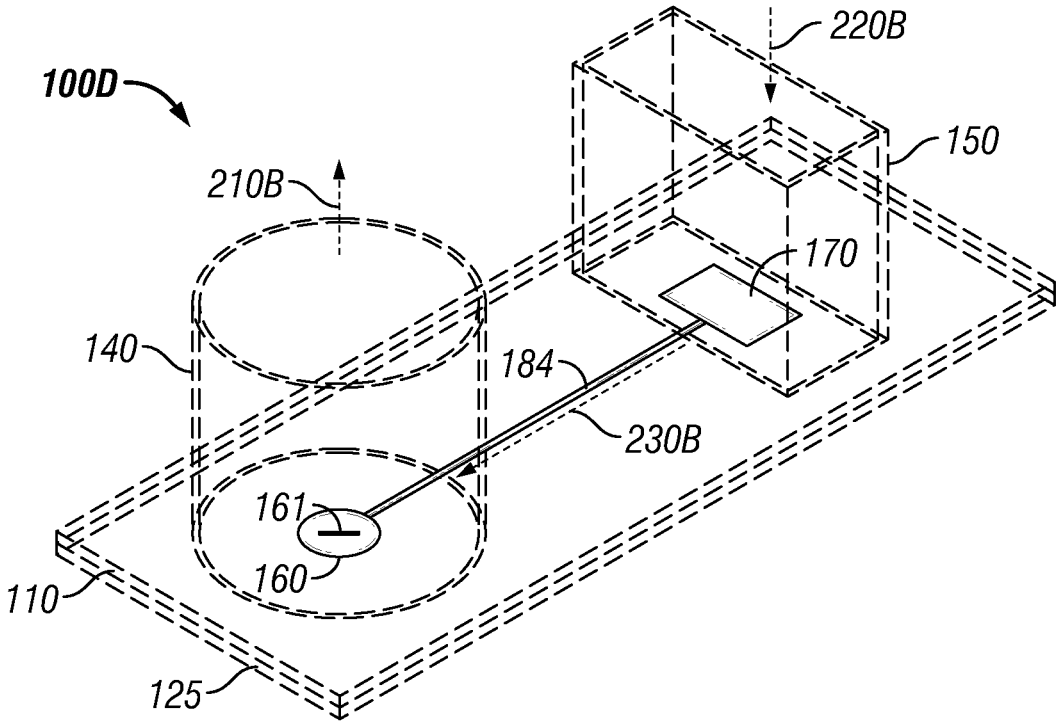
FIG. 11B is a transparent perspective view of an example of an apparatus for transitioning electromagnetic waves between different propagation modes.

FIG. 11B is a transparent perspective view of an example of an apparatus 100D for transitioning electromagnetic waves between propagation modes. The apparatus 100D is shown in a transparent perspective view for clarity. The apparatus 100D includes a substrate 110 having a first antenna element 160, a first waveguide 140, a second antenna element 170, and a second waveguide 150 each attached to a surface of the substrate 110. The first antenna element 160 is a circular antenna element with a slot 161 through the circular antenna element. The second antenna element 170 is a rectangular antenna element. The first waveguide 140 has a circular cross-section and the second waveguide 150 has a rectangular cross-section. The first antenna element 160 is capacitively coupled to an electrical path 184 positioned within the substrate 110. The second antenna element 170 is also capacitively coupled to the electrical path 184 positioned within the substrate 110.

FIG. 11B shows the transition of linear polarized electromagnetic waves to circular polarized electromagnetic waves. Linear polarized electromagnetic waves enter the second waveguide 150 as indicated arrow 220B and propagate to the second antenna element 170. The linear polarized electromagnetic waves propagate in TE mode as discussed herein. The second antenna element 170 is capacitively coupled to the electrical path 184. As the waves propagate along the electrical path 184 as shown by arrow 230B the electromagnetic waves transition to TEM mode as discussed herein. When the electromagnetic waves reach the end of the electrical path 184 the electromagnetic waves transition back to TE mode as the first antenna element 160 is capacitively coupled to the end of the electrical path 184. The first antenna element 160, which is a circular antenna element, and the first waveguide 140, which has a circular cross-section, transition the electromagnetic waves into circular polarized electromagnetic waves as indicated by 210B.

Figure 12:
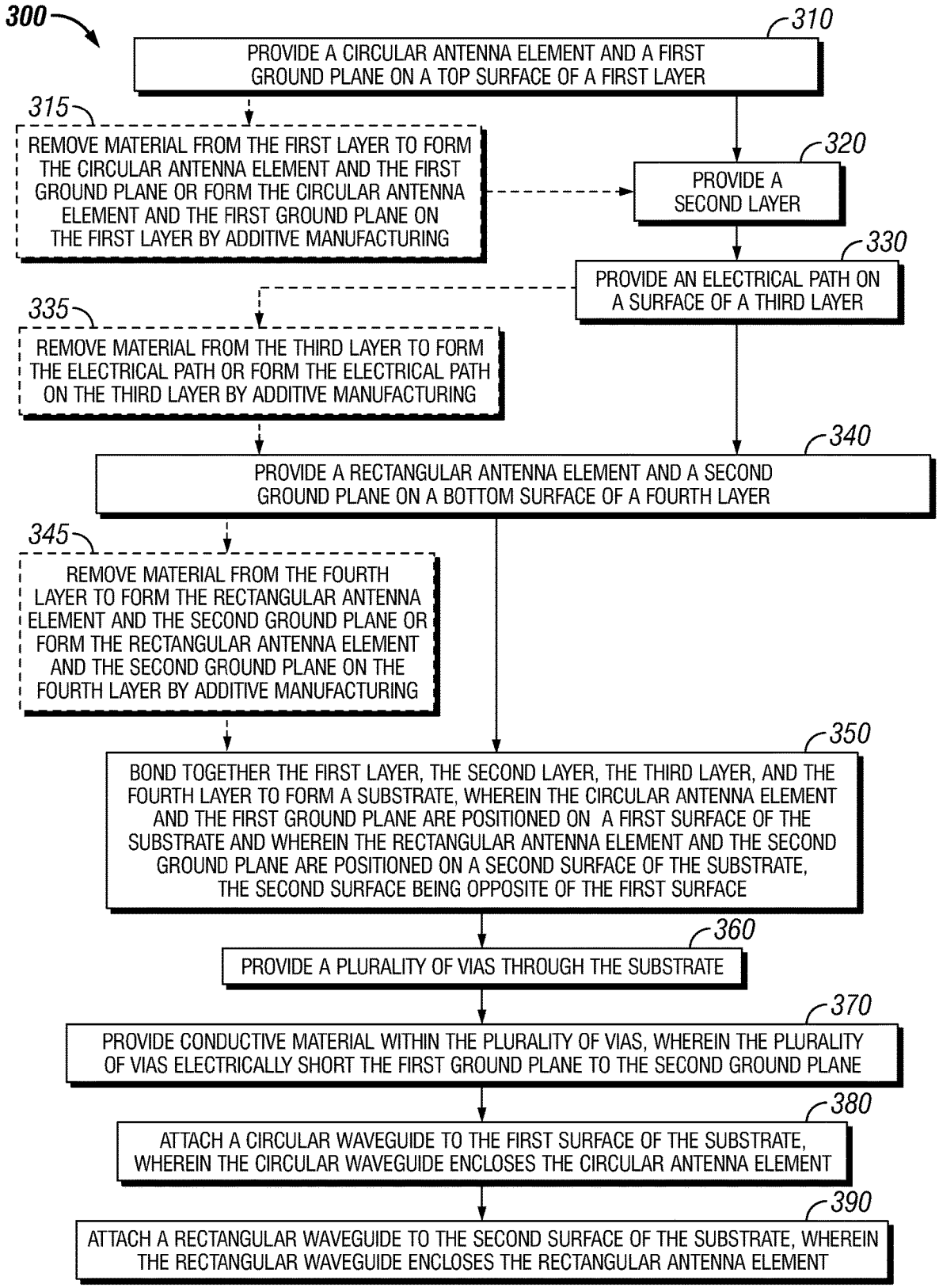
FIG. 12 is a flow chart for an example of a method of providing an apparatus for transitioning electromagnetic waves between different propagation modes.

FIG. 12 is a flow chart of an example method 300 of the present disclosure. The method 300 includes providing a circular antenna element and a first ground plane on a top surface of a first layer, at 310. The method 300 may include removing material from the first layer to form the circular antenna element and the first ground plane or forming the circular antenna element and the first ground plane on the first layer by additive manufacturing, at 315. The method 300 includes providing a second layer, at 320.

The method 300 includes providing an electrical path on a surface of a third layer, at 330. The method 300 may include removing material from the third layer to form the electrical path or forming the electrical path on the third layer by additive manufacturing, at 335. The method 300 includes providing a rectangular antenna element and a second ground plane on a bottom surface of a fourth layer, at 340. The method 300 may include removing material from the fourth layer to form the rectangular antenna element and the second ground plane or forming the rectangular antenna element and the second ground plane on the fourth layer by additive manufacturing, at 345. The method 300 includes bonding together the first layer, the second layer, the third layer, and the fourth layer to form a substrate, wherein the circular antenna element and the first ground plane are positioned on a first surface of the substrate and wherein the rectangular antenna element and the second ground plane are positioned on a second surface of the substrate, the second surface being opposite of the first surface, at 350.

The method 300 may include providing a plurality of vias through the substrate, at 360. The method 300 may include providing conductive material within the plurality of vias, wherein the plurality of vias electrically short the first ground plane to the second ground plane, at 370. The method 300 may include attaching a circular waveguide to the first surface of the substrate, wherein the circular waveguide encloses the circular antenna element, at 380. The method 300 may include attaching a rectangular waveguide to the second surface of the substrate, wherein the rectangular waveguide encloses the rectangular antenna element, at 390.

Figure 13:
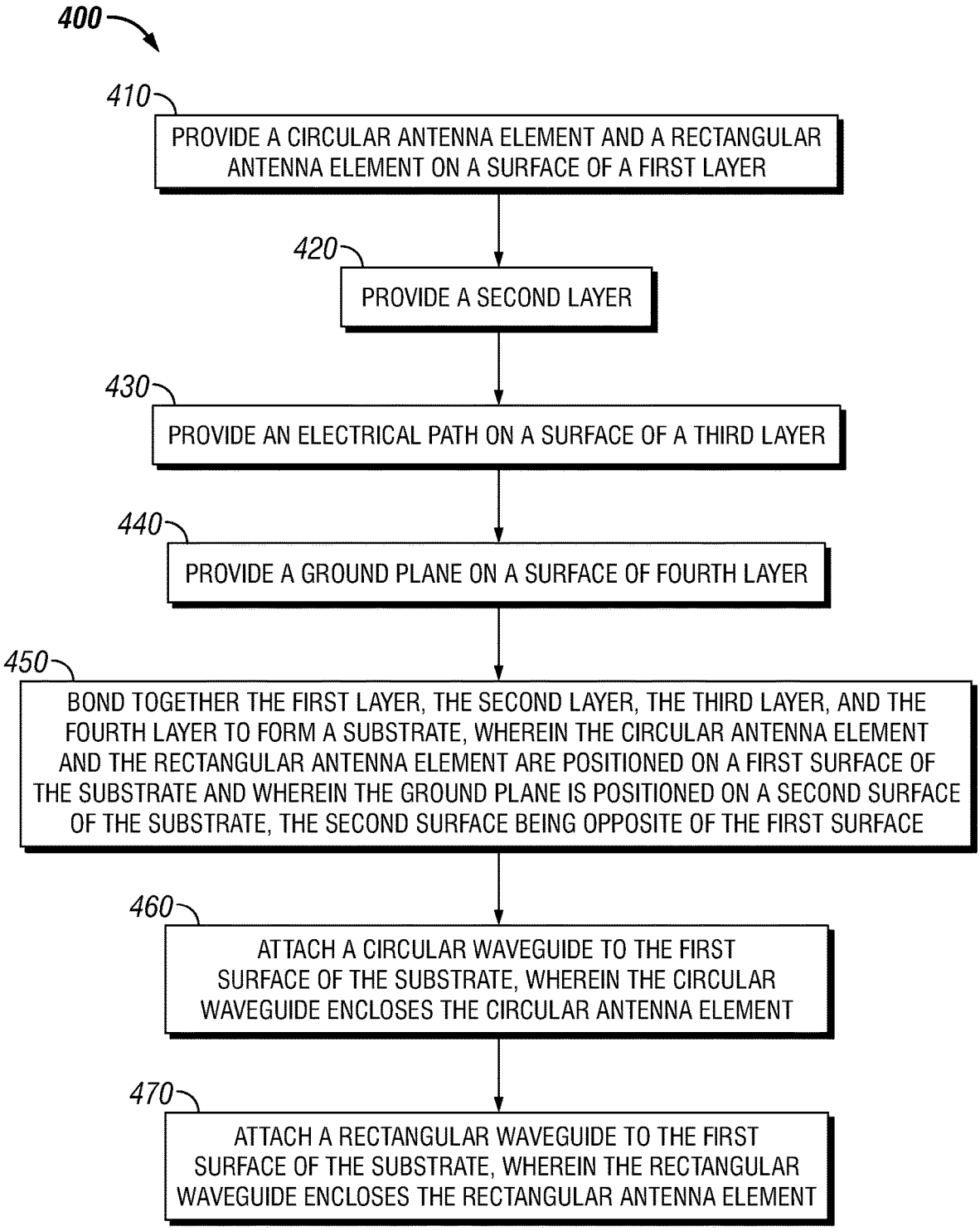
FIG. 13 is a flow chart for an example of a method of providing an apparatus for transitioning electromagnetic waves between different propagation modes.

FIG. 13 is a flow chart of an example method 400 of the present disclosure. The method 400 includes providing a circular antenna element and a rectangular antenna element on a surface of a first layer, at 410. The method 400 includes providing a second layer, at 420. The method 400 includes providing an electrical path on a surface of a third layer, at 430. The method 400 includes providing a ground plane on a surface of a fourth layer, at 440. The method 400 includes bonding together the first layer, the second layer, the third layer, and the fourth layer to form a substrate, wherein the circular antenna element and the rectangular antenna element are positioned on a first surface of the substrate and wherein the ground plane is positioned on a second surface of the substrate, the second surface being opposite of the first surface, at 450.

The method 400 may include attaching a circular waveguide to the first surface of the substrate, wherein the circular waveguide encloses the circular antenna element, at 460. The method 400 may include attaching a rectangular waveguide to the first surface of the substrate, wherein the rectangular waveguide encloses the rectangular antenna element, at 470.

Although this disclosure has been described in terms of certain embodiments, other embodiments that are apparent to those of ordinary skill in the art, including embodiments that do not provide all of the features and advantages set forth herein, are also within the scope of this disclosure. Accordingly, the scope of the present disclosure is defined only by reference to the appended claims and equivalents thereof.

What is claimed is:

1. An apparatus comprising:

a substrate;

an electrical path positioned within the substrate;

a first antenna element attached to the substrate, the first antenna element is capacitively coupled to the electrical path;

a second antenna element attached to the substrate, the second antenna element is capacitively coupled to the electrical path;

a ground plane positioned on the substrate;

wherein electromagnetic waves propagate along the electrical path in a transverse electromagnetic mode; and wherein electromagnetic waves transition from circular polarized electromagnetic waves to linear polarized electromagnetic waves when moving in a first direction from the first antenna element to the second antenna element and wherein electromagnetic waves transition from linear polarized electromagnetic waves to circular polarized electromagnetic waves when moving in a second direction from the second antenna element to the first antenna element.

2. The apparatus of claim 1, comprising:

a first waveguide having a first interior, the first waveguide attached to the substrate, wherein the first antenna element is positioned within the first interior of the first waveguide; and a second waveguide having a second interior, the second waveguide attached to the substrate, wherein the second antenna element is positioned within the second interior of the second waveguide.

3. The apparatus of claim 2, the first waveguide having a first central axis and the second waveguide having a second central axis, wherein the second central axis is offset from the first central axis.

4. The apparatus of claim 1, comprising:

wherein the substrate has a first surface and a second surface opposite the first surface;

wherein the ground plane further comprises a first ground plane positioned on the first surface of the substrate;

a second ground plane positioned on the second surface of the substrate;

at least one via that electrically shorts the second ground plane to the first ground plane;

wherein the first antenna element is positioned on the first surface of the substrate; and wherein the second antenna element is positioned on the second surface of the substrate.

5. The apparatus of claim 4, comprising:

a first waveguide having a first interior, the first waveguide attached to the substrate, wherein the first antenna element is positioned within the first interior of the first waveguide; and a second waveguide having a second interior, the second waveguide attached to the substrate, wherein the second antenna element is positioned within the second interior of the second waveguide.

6. The apparatus of claim 5, comprising:

wherein the first waveguide has a circular cross-section;

wherein the first antenna element is a circular antenna element;

wherein the second waveguide has a rectangular cross-section; and wherein the second antenna element is a rectangular antenna element.

7. The apparatus of claim 6, the electrical path comprising a first microstrip, a second microstrip, and a stripline connected between the first microstrip and the second microstrip, wherein the first antenna element is capacitively coupled to the first microstrip and wherein the second antenna element is capacitively coupled to the second microstrip.

8. The apparatus of claim 7, comprising a slot through the first antenna element.

9. The apparatus of claim 1, wherein the substrate comprises a plurality of layers and wherein the electrical path is positioned on an internal layer of the plurality of layers.

10. A method comprising:

providing a circular antenna element and a first ground plane on a top surface of a first layer;

providing a second layer;

providing an electrical path on a surface of a third layer;

providing a rectangular antenna element and a second ground plane on a bottom surface of a fourth layer; and bonding together the first layer, the second layer, the third layer, and the fourth layer to form a substrate, wherein the circular antenna element and the first ground plane are positioned on a first surface of the substrate and wherein the rectangular antenna element and the second ground plane are positioned on a second surface of the substrate, the second surface being opposite of the first surface.

11. The method of claim 10, wherein the circular antenna element is capacitively coupled to a first portion of the electrical path on the surface of the third layer and wherein the rectangular antenna element is capacitively coupled to a second portion of the electrical path on the surface of the third layer.

12. The method of claim 11, wherein the electrical path further comprises a first microstrip, a second microstrip, and a stripline connected between the first microstrip and the second microstrip, wherein the first portion of the electrical path is the first microstrip and wherein the second portion of the electrical path is the second microstrip.

13. The method of claim 12, comprising:

providing a plurality of vias through the substrate; and providing conductive material within the plurality of vias, wherein the plurality of vias electrically short the first ground plane with the second ground plane.

14. The method of claim 13, comprising:

attaching a circular waveguide to the first surface of the substrate, wherein the circular waveguide encloses the circular antenna element; and attaching a rectangular waveguide to the second surface of the substrate, wherein the rectangular waveguide encloses the rectangular antenna element.

15. The method of claim 10, wherein providing the circular antenna element and the first ground plane on the top surface of the first layer comprises removing material from the first layer to form the circular antenna element and the first ground plane or comprises forming the circular antenna element and the first ground plane on the first layer by additive manufacturing.

16. The method of claim 10, wherein providing the electrical path on the surface of the third layer comprises removing material from the third layer to form the electrical path or comprises forming the electrical path on the third layer by additive manufacturing.

17. The method of claim 10, wherein providing the rectangular antenna element and the second ground plane on the bottom surface of the fourth layer comprises removing material from the fourth layer to form the rectangular antenna element and the second ground plane or comprises forming the rectangular antenna element and the second ground plane on the fourth layer by additive manufacturing.

18. A method comprising:

providing a circular antenna element and a rectangular antenna element on a surface of a first layer;

providing a second layer;

providing an electrical path on a surface of a third layer;

providing a ground plane on a surface of a fourth layer; and bonding together the first layer, the second layer, the third layer, and the fourth layer to form a substrate, wherein the circular antenna element and the rectangular antenna element are positioned on a first surface of the substrate and wherein the ground plane is positioned on a second surface of the substrate, the second surface being opposite of the first surface.

19. The method of claim 18, wherein the circular antenna element is capacitively coupled to the electrical path and wherein the rectangular antenna element is capacitively coupled to the electrical path.

20. The method of claim 19, further comprising:

attaching a circular waveguide to the first surface of the substrate, wherein the circular waveguide encloses the circular antenna element; and attaching a rectangular waveguide to the first surface of the substrate, wherein the rectangular waveguide encloses the rectangular antenna element.

* * * * *